US012622568B2

(12) United States Patent
Kane

(10) Patent No.: US 12,622,568 B2
(45) Date of Patent: May 12, 2026

(54) DISH DRYING MAT

(71) Applicant: MACNEIL IP LLC, Bolingbrook, IL (US)

(72) Inventor: Stephen Kane, Cedar Lake, IN (US)

(73) Assignee: MACNEIL IP LLC, Bolingbrook, IL (US)

( * ) Notice: Subject to any disclaimer, the term of this patent is extended or adjusted under 35 U.S.C. 154(b) by 0 days.

(21) Appl. No.: 18/807,371

(22) Filed: Aug. 16, 2024

(65) Prior Publication Data

US 2026/0047744 A1 Feb. 19, 2026

(51) Int. Cl.

| | |
|---|---|
| ***A47L 19/02*** | (2006.01) |
| ***A47B 81/04*** | (2006.01) |
| ***A47G 23/03*** | (2006.01) |

(52) U.S. Cl.

CPC ..... *A47L 19/02* (2013.01); *A47B 81/04* (2013.01); *A47G 23/03* (2013.01)

(58) Field of Classification Search

CPC ..... A47L 19/02; A47L 19/00; A47L 15/50; A47L 15/503; A47G 23/032; A47G 23/0303; A47G 23/03; A47B 77/06; A47B 81/04; A47J 47/20

See application file for complete search history.

(56) References Cited

U.S. PATENT DOCUMENTS

| | | | | | |
|---|---|---|---|---|---|
| 2,512,310 | A * | 6/1950 | Corson | A47G 27/0231 D6/583 |
| D392,924 | S * | 3/1998 | Shleymovich | D12/608 |
| D423,440 | S * | 4/2000 | Sneed | D12/203 |
| D508,368 | S * | 8/2005 | Lion | D7/388 |
| D602,733 | S * | 10/2009 | Huber | D7/388 |
| D693,082 | S * | 11/2013 | Evans | D32/56 |
| 9,675,151 | B1 * | 6/2017 | MacNeil | A47G 29/083 |
| 9,730,571 | B1 * | 8/2017 | Lee | A47L 19/04 |
| 10,297,333 | B2 * | 5/2019 | McConnell | G11C 29/76 |
| D993,564 | S * | 7/2023 | Chen | D32/55 |
| D995,024 | S * | 8/2023 | Chen | D32/57 |
| D1,071,462 | S * | 4/2025 | Kane | D32/57 |
| 2016/0206176 | A1 * | 7/2016 | Eilmus | A47J 47/20 |
| 2018/0368601 | A1 * | 12/2018 | Masanek, Jr. | B29C 45/0001 |
| 2024/0298871 | A1 * | 9/2024 | Min | A47L 19/02 |
| 2024/0406640 | A1 * | 12/2024 | Klug | B81B 7/0025 |
| 2025/0064293 | A1 * | 2/2025 | Carr | A47J 47/16 |

* cited by examiner

*Primary Examiner* — Devin K Barnett
(74) *Attorney, Agent, or Firm* — Perkins IP Law Group LLC; Jefferson Perkins

(57) ABSTRACT

A dish drying mat has elongate spaced-apart ribs upwardly extending from a general upper surface, and spaced-apart dimples downwardly extending from a general lower surface. The lateral locations of the ribs and the dimples do not intersect. A lower portion of a marginal wall has at least one gap so as to communicate a continuous lower volume below the general lower surface to the atmosphere beyond the peripheral margin of the mat. At rounded corners, the peripheral wall has inwardly concave surfaces which are sized to fit to a thumb or finger of a user's hand when grasping or cleaning the mat.

4 Claims, 5 Drawing Sheets

DISH DRYING MAT

BACKGROUND OF THE INVENTION

The dishes, vessels and implements used to prepare and serve a meal are often washed by hand and are set aside next to a kitchen sink to dry. A dish drying mat, such as one that may be placed under a dish rack, contains drips from the wet dishes and prevents them from spreading over the countertop and/or the floor. Dish drying mats have been made of coated and noncoated metal, cloth, rubber and plastic.

Where the dish drying mat is made of a fluid-impervious rather an absorbent material, dishwater will sometimes find its way under the mat and stay there in an unevaporated condition. This is undesirable.

Often a dish drying mat will have raised ribs or the like to elevate the items placed there for drying above a general upper surface of the mat. If these raised features make sharp corners with the general upper surface of the mat, the resultant mat will be difficult to keep clean and instead will provide locations where bacteria may grow.

Improvements may therefore be made in conventional dish drying mats to enhance their utility and cleanliness.

SUMMARY OF THE INVENTION

According to one aspect of the invention, a dish drying mat has a body with a general upper surface and a general lower surface spaced from the general upper surface. A plurality of elongate, laterally spaced apart ribs upwardly extend from the general upper surface, and occupy respective lateral rib locations. A plurality of laterally spaced apart dimples downwardly extend from the general lower surface, with each dimple occupying a respective lateral dimple location. The lateral rib locations and lateral dimple locations have no intersection; as vertically projected onto a common horizontal plane, the lateral rib locations and lateral dimple locations are entirely distinct from each other. This makes the mat easier to mold from a thermoplastic polymer.

In one embodiment, the body, ribs and dimples are integrally molded of a fluid-impervious material. For example, the body, ribs and dimples may be integrally injection-molded of a thermoplastic elastomer.

In embodiments, the ribs have elongate sidewalls joined together by endwalls. These sidewalls and endwalls may each make a concave curved transition to the general upper surface, where the radius of curved transition may be selected from the range of about 0.04 to about 0.1 in. More particularly, the radius of the curved transitions may be about 0.1 in.

The body may have a horizontal peripheral margin, at which a bottom wall downwardly extends from the general lower surface. At least one gap is formed in this bottom wall. The bottom wall and the dimples space the general lower surface of the body from a horizontal support surface so as to create a lower space or volume bounded by the general lower surface, the support surface and the horizontal peripheral margin. The gap communicates this lower space to the atmosphere, permitting any water finding its way therein to evaporate.

According to another aspect of the invention, a dish drying mat comprises a body with a general upper surface and a general lower surface spaced from the general upper surface. The body has a lateral margin. A plurality of dimples downwardly extend from the general lower surface by a uniform height. The dimples are spaced apart from each other and act to support the body on a horizontal support surface. A continuous lower space is bounded by the support surface, the general lower surface and the lateral margin. The continuous lower space is in communication with the atmosphere beyond the lateral margin, such that any fluid in the continuous lower space may evaporate.

In one embodiment, a bottom wall downwardly extends from the general lower surface by the uniform height. At least one gap in the bottom wall communicates the continuous lower space with the atmosphere beyond the lateral margin. The mat may have a left side, an opposed right side, a front side and an opposed back side, and in one embodiment gaps are formed in the bottom wall at each of the sides.

In a further aspect of the invention, a dish drying mat is provided that has a body with a lateral peripheral margin, a general upper surface and a general lower surface. A plurality of elongate ribs upwardly extend from the general upper surface. The ribs are spaced from each other and from the peripheral lateral margin. A plurality of dimples downwardly extend from the general lower surface. The dimples are spaced from each other and from the peripheral lateral margin. The lateral peripheral margin has a plurality of horizontal sides, and adjacent ones of the sides meet at rounded corners. A peripheral wall is formed at least at the corners to upwardly extend from the general upper surface and to downwardly extend from the general lower surface. At each corner, the upper portion of the peripheral wall has an inwardly-facing concave surface, and the lower portion does likewise. Horizontal radii of these concave surfaces may be selected from the range of about 0.4 to about 0.6 in., such that two opposed human fingers may fit to an interior concave surfaces of the upper and lower peripheral wall portions at the corners, thereby permitting a user to easily grasp the mat, and so that the concave surfaces may be easily cleaned.

The dish drying mat provided by the invention does not trap water, is readily moldable by an injection molding process, may be easily manipulated and is easy to keep clean by avoiding sharp corners and creases.

BRIEF DESCRIPTION OF THE DRAWINGS

Further aspects of the invention and their advantages can be discerned in the following detailed description as read in conjunction with the drawings of exemplary embodiments, in which like characters denote like parts and in which.

DETAILED DESCRIPTION

As used herein, "laterally" and "lateral" denote a direction in a horizontal plane, the direction being 90 degrees from the vertical.

Figure 1:
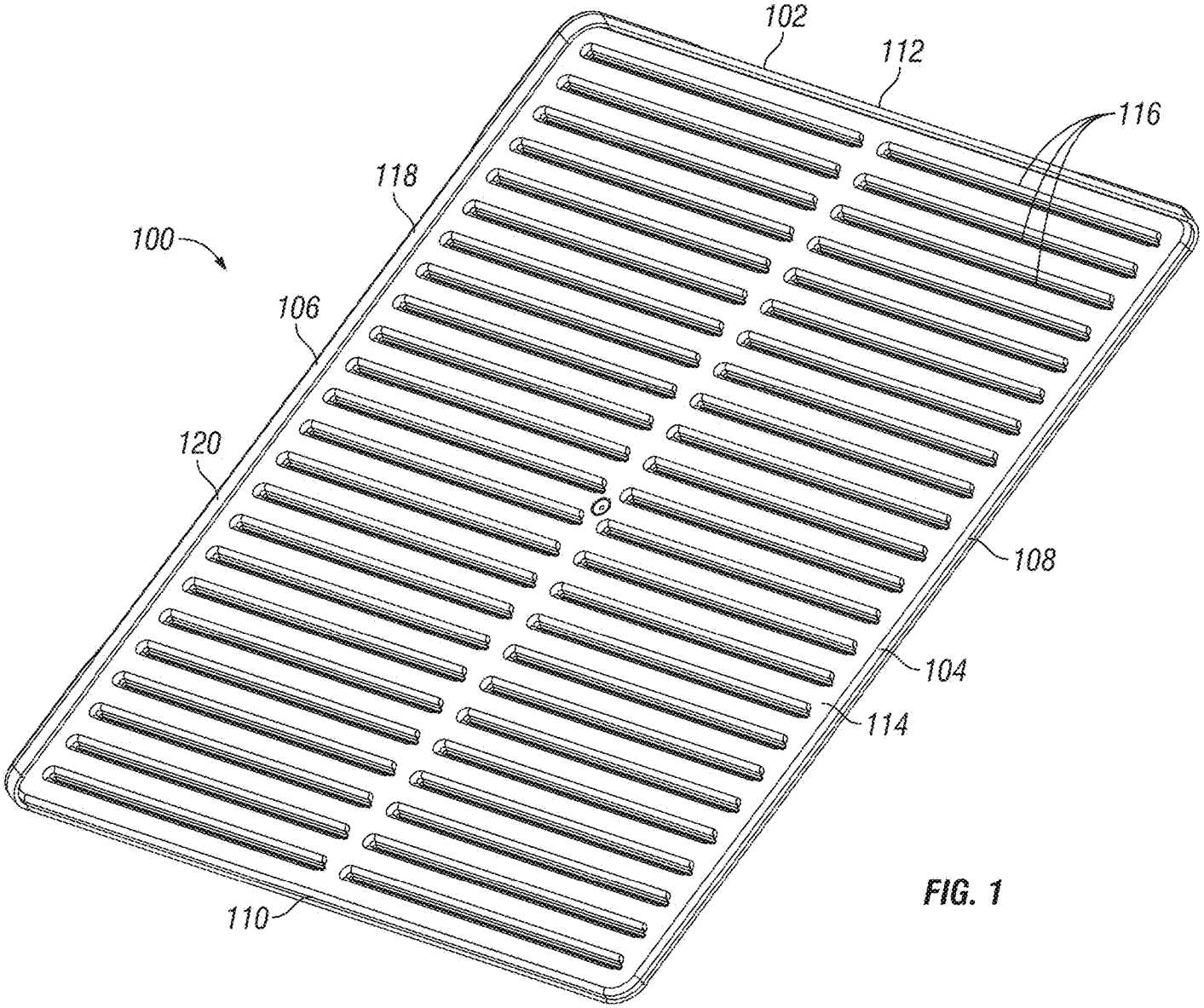
FIG. 1 is a top perspective view of a dish drying mat according to the invention.

One embodiment of a dish drying mat according to the invention is shown at 100 in FIG. 1. The mat 100 has a body 102 with a lateral margin 104. Margin 104 includes a left side 106, an opposed right side 108, a front side 110 and an opposed back side 112. A general upper surface 114 extends between sides 104 and 106 and sides 110 and 112. The general upper surface can be flat and can conform to a horizontal plane.

A plurality of elongate, spaced-apart ribs 116 upwardly extend from the general upper surface 114. Ribs 116 may be parallel to each other and arranged in two rows, as shown. Each of the ribs 116 has a uniform height, such as 0.23 in. A peripheral wall 118 is disposed at least at the rounded corners of the lateral margin 104 and in the illustrated embodiment completely surrounds the general upper surface 114. An upper portion 120 thereof upwardly extends from the general upper surface 114 by a uniform height, such as 0.23 in. Wall 118 laterally contains any fluid dripping off of the dishes as they dry. The ribs 116 support dishes, glasses, utensils, pots, pans, etc. off of the general upper surface 114, and therefore out of any water or fluid that collects there. The general upper surface 114, in combination with the upper portion 120 of peripheral wall 118, defines a reservoir where drip water and the like can be collected and held to evaporate.

Figure 2:
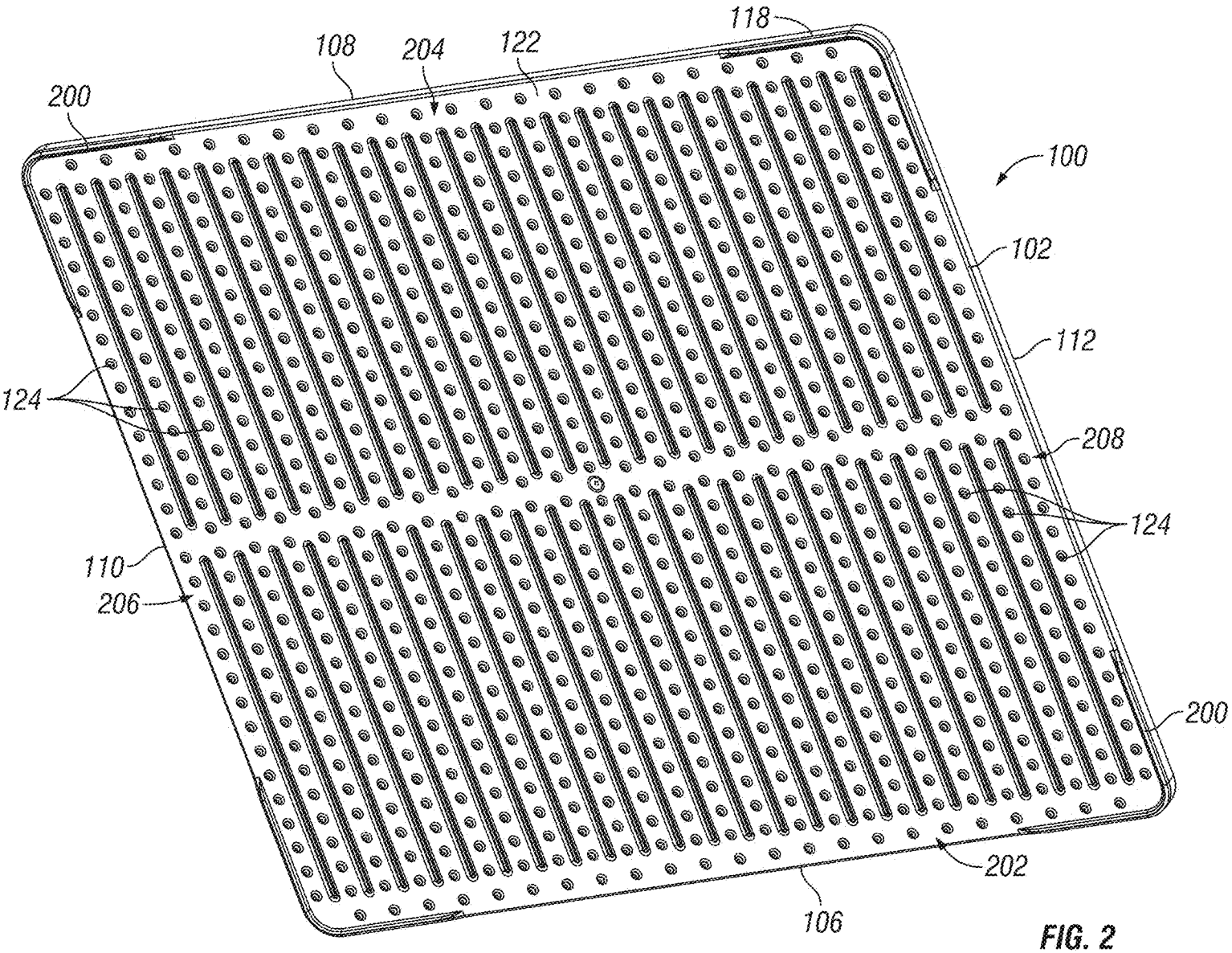
FIG. 2 is a bottom perspective view of the mat shown in FIG. 1.

As seen in FIG. 2, a lower surface of mat body 102 includes a flat and horizontal general lower surface 122. A plurality of dimples 124 downwardly (in this view, upwardly) extend from the general lower surface 122 by a uniform dimple height, such as 0.07 in. Dimples 124 are spaced apart from each other in both a lengthwise and a widthwise direction. The dimples 124 may be uniformly spaced in a two-dimensional array. In terms of horizontal area, the dimples 124 occupy only a small portion of the lower surface of mat 100, with the general lower surface 122 being a much greater component.

A lower portion 200 of peripheral wall 118 downwardly extends from the general lower surface 122 by a uniform height such as 0.07 in. Lower wall portion 200 is not continuous but instead has at least one gap in it, and in the illustrated embodiment, four such gaps 202, 204, 206, 208, on sides 106, 108, 110 and 112, respectively.

Figure 3:
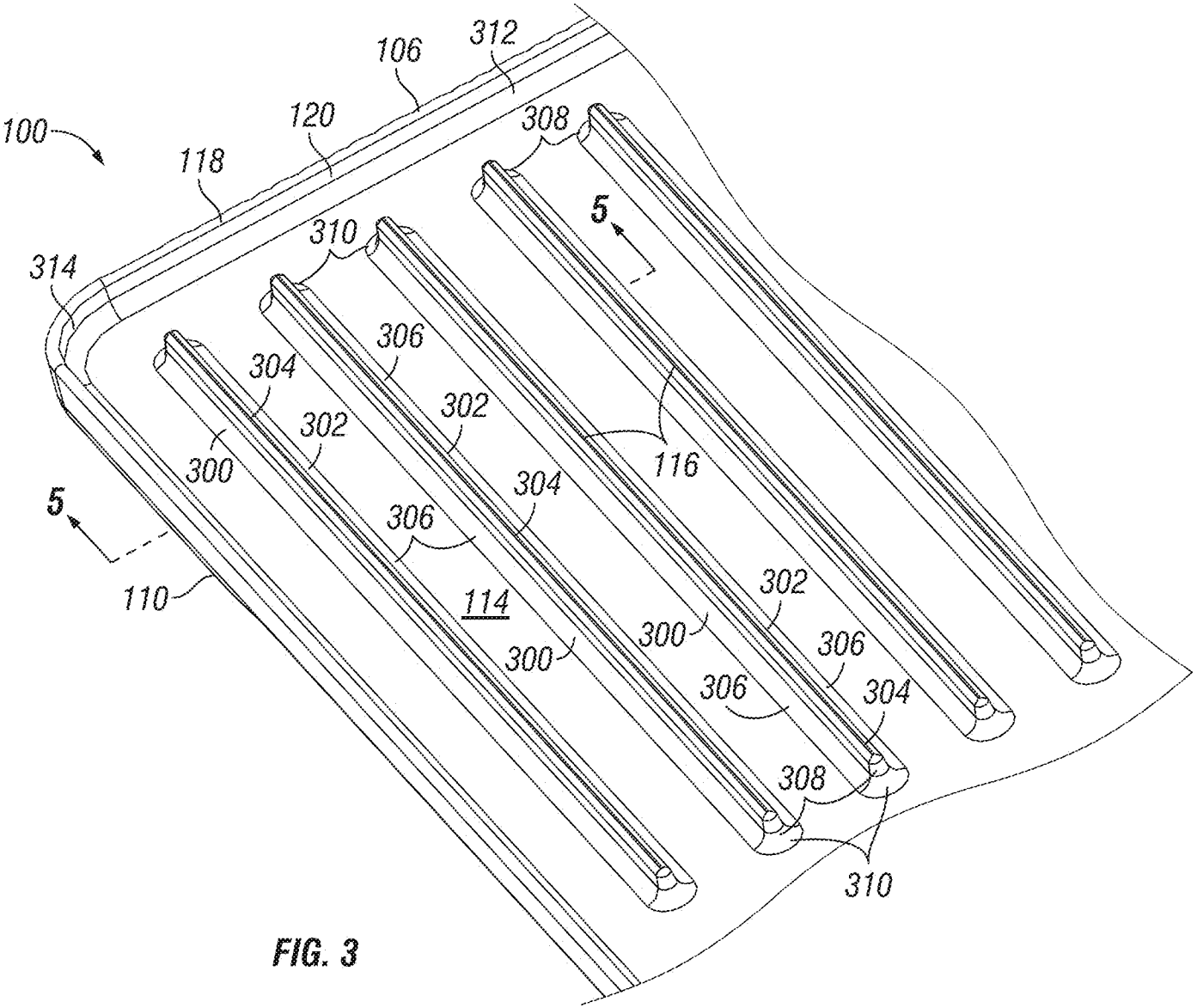
FIG. 3 is a detail of FIG. 1.

FIG. 3 is detail of a portion of the upper surface of mat 100. Each of the ribs 116 has a pair of elongate parallel sidewalls 300, 302 that meet at an upwardly convex rib top 304. A spacing between the centers of ribs 116 can be about 0.72 in. The surfaces of rib sidewalls 300, 302 each make an upwardly concave curved transition 306 to the general upper surface 114. Each rib 116 further has endwalls 308 that join together the lateral ends of the rib sidewalls 300, 302. Like sidewalls 300, 302, the endwalls 308 make an upwardly concave curved transition 310 to general upper surface 114. In similar fashion, upper peripheral wall portion 120 makes a concave curved transition 312 to the general upper surface 114. The radius of curved transitions 306, 310, 312 is at least 0.04 in., and in the illustrated embodiment are about 0.1 in.

Upper peripheral wall portion 120 makes a rounded corner 314 between adjacent sides, such as sides 106 and 110 in FIG. 3. Similar rounded corners are disposed at the intersections of sides 106 and 112, 112 and 108, and 108 and 110. A radius of corner 314 is chosen such that an interiorly facing concave surface of the corner fits to a typical human thumb or finger, and may be in the range of 0.4 to 0.6 in. This also makes corners 314 easier to clean.

Figure 4:
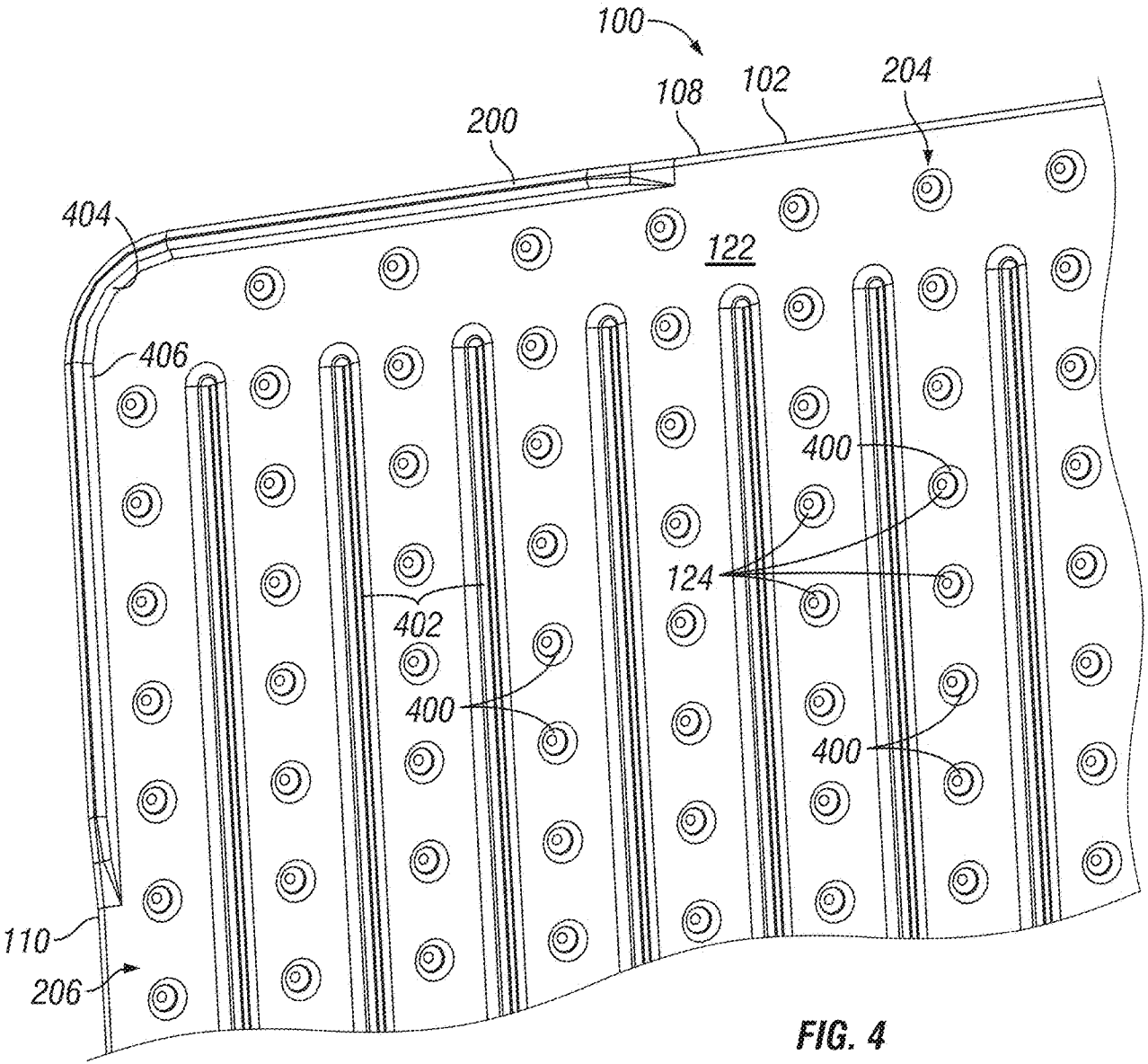
FIG. 4 is a detail of FIG. 2.

FIG. 4 is a detail of the lower surface of mat 100. Each of the dimples 124 may have a radius of 0.075 in. and makes a round, downwardly concave curved transition 400 to the general lower surface 122. The radius of curved transitions 400 may be about 0.04-0.08 in. The dimples 124 may be spaced apart from each other by a spacing, center-to-center, of about 0.72 in.

A plurality of parallel, spaced-apart, elongate grooves 402 upwardly (in this bottom view, downwardly) extend from general lower surface 122. Each of the grooves is laterally collocated with a rib 116 on the upper surface of body 102. The grooves 402 make ribs 116 partially hollow and enhance the moldability of body 102. A height of each groove 402, as measured from general lower surface 122 to a ceiling of the groove 402, may be about 0.05 in.

The lateral location of each of the grooves 402 is inside of a respective lateral location of a rib 116 on the upper side of the mat 100. But the lateral locations of the dimples 124 are entirely distinct from and do not intersect the lateral locations of the ribs 116. By this arrangement, the mat avoids having, in many places, a body thickness that is a stackup of the nominal thickness of the body 102, the height of a rib 116, and the height of a dimple 124. This enhances the moldability of the mat 100.

Where a mat side transitions to an adjacent mat side, such as a transition between sides 108 and 110, there is a rounded corner 404 of the lower portion 200 of the marginal wall. An interiorly facing concave curved transition 406 is made by corner 404 and the rest of lower portion 200 to the general lower surface 122. A radius in a horizontal plane of corner 404 may match the radius made at upper wall portion corner 314 (FIG. 3), and may be about 0.4-0.6 in. The concave surfaces of corners 314 and 404 may fit to a typical human finger and thumb, allowing a user to easily grasp the mat 100 at one of the corners, and make them easier to clean. Gaps 202, 204, 206 and 208 aid in the insertion of a human finger underneath the mat body 102, facilitating picking it up.

A height of the lower wall portion may be about 0.07 in., and should match the uniform height of the dimples from general lower surface 122, which can also be about 0.07 in.

Figure 5:
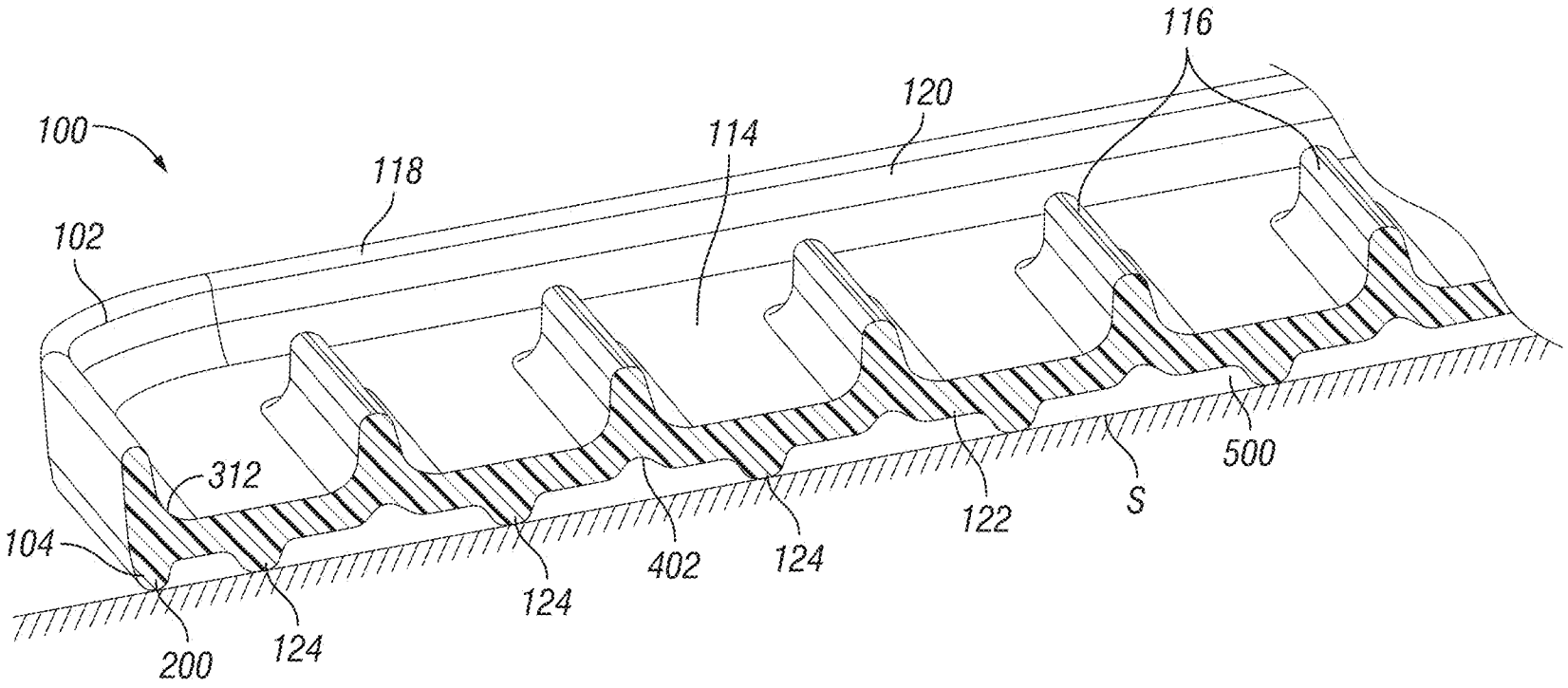
FIG. 5 is a sectional view taken substantially along line 5-5 of FIG. 3.

In the sectional view of FIG. 5, it is seen that the general upper surface 114 is upwardly spaced from the general lower surface 122 by a substantially uniform, nominal body thickness. The grooves 402 are made so that the ribs 116 are partially hollow, and so that the thickness of the walls making up the ribs 116 does not depart by too much from the nominal thickness, enhancing moldability. The section also further illustrates that the lateral locations of the dimples 124 do not at all intersect with the lateral locations of the ribs 116; they are spaced in a horizontal direction from each other.

Mat 100 can be integrally molded of a fluid-impervious material, and in one embodiment is integrally injection-molded of a thermoplastic elastomer.

FIG. 5 depicts a mat 100 resting on a support surface S, such as a surface of a kitchen countertop next to a sink. A continuous lower space or volume 500 is defined by general lower surface 122, surface S and lateral margin 104. The volume 500 is continuous in that no body support element, such as dimples 124 or peripheral wall lower portion 200, will cut off any portion of volume 500 from any other portion of it. Further, volume 500 communicates to the atmosphere beyond lateral margin 104 via gaps 202-208 (FIG. 2) in lower wall portion 200, so that exterior air is free to circulate throughout volume 500. Thus, if any water or other fluid gets into volume 500, it will be exposed to dry air and as such will more readily evaporate.

In summary, a dish drying mat has been provided that permits optimum evaporation of drip water, is easy to clean through the use of curved transitions between its structures, and is easy to injection-mold through its differential placement of article-supporting ribs and mat-supporting dimples.

While illustrated embodiments of the present invention have been described and illustrated in the appended drawings, the present invention is not limited thereto but only by the scope and spirit of the appended claims.

I claim:

1. A dish drying mat, comprising:

a body having a general upper surface and a general lower surface spaced from the general upper surface;

a plurality of elongate, laterally spaced apart ribs upwardly extending from the general upper surface, each rib occupying a respective lateral rib location; and a plurality of laterally spaced apart dimples downwardly extending from the general lower surface, each dimple occupying a respective lateral dimple location; wherein the lateral rib locations and the lateral dimple locations have no intersection, and wherein the general lower surface is spaced from the general upper surface by a substantially uniform body thickness, each of the ribs being at least partially hollow and being formed by walls having a thickness substantially the same as the substantially uniform body thickness, each rib having a downwardly open groove, and wherein the body, ribs and dimples are integrally injection-molded from a thermoplastic polymer.

2. The dish drying mat of claim 1, wherein each dimple has a sidewall that includes a concave curved transition to the general lower surface of the body, a radius of the concave curved transition being selected from the range of 0.04 to 0.08 in.

3. The dish drying mat of claim 1, wherein each rib has first and second elongate rib sidewalls connected together by end walls, each rib sidewall and end wall making a concave curved transition to the general upper surface, a radius of the concave curved transition being greater than about 0.1 inches.

4. The dish drying mat of claim 1, wherein the dish drying mat is adapted to be placed in an atmosphere and wherein the body has a horizontal margin, a bottom wall downwardly extending from the general lower surface at the horizontal margin, at least one gap formed in the bottom wall, the dimples and the bottom wall spacing the general lower surface of the body from a support surface so as to create a lower space disposed beneath the general lower surface, the at least one gap communicating the lower space to the atmosphere.

* * * * *